United States Patent [19]

LaRoche et al.

[11] Patent Number: 4,977,719

[45] **Date of Patent: * Dec. 18, 1990**

[54] FIRE RESISTANT EXPANSION JOINT

[76] Inventors: Allan R. LaRoche, 1458 Deerfield Cir., Roseville, Calif. 95678; Douglas S. Pearmain, 44 Fern St., Auburn, Me. 04210; Denis M. Kelleher, 3981 S. Benton Way, Denver, Colo. 80235

[ * ] Notice: The portion of the term of this patent subsequent to Sep. 19, 2006 has been disclaimed.

[21] Appl. No.: 403,531

[22] Filed: Sep. 6, 1989

Related U.S. Application Data

[63] Continuation-in-part of Ser. No. 7,208,696, Jun. 20, 1988, Pat. No. 4,866,898.

[51] Int. Cl.[5] ..... E04B 1/74

[52] U.S. Cl. ..... 52/396; 52/403; 52/573

[58] Field of Search ..... 52/396, 403, 573, 317; 165/131, 81; 404/53, 54, 56, 68, 69

[56] References Cited

U.S. PATENT DOCUMENTS

| | | | |
|---|---|---|---|
| 4,517,779 | 5/1985 | Dunsworth | 52/573 X |
| 4,566,242 | 1/1986 | Dunsworth | 52/573 X |
| 4,750,301 | 6/1988 | Croxford | 52/396 |
| 4,811,529 | 3/1989 | Harris et al. | 52/396 |
| 4,833,851 | 5/1989 | Ohmatsu | 52/573 X |

*Primary Examiner*—David A. Scherbel
*Assistant Examiner*—Lan Mai

[57] ABSTRACT

An expansion joint for interior or exterior use including a fire barrier comprised of a fire resistant inorganic refractory fiber fabric sheet which supports resilient fire resistant inorganic refractory fibers. The support sheet may be closed to form a sleeve. When used as an exterior expansion joint a weather resistant cover comprising a bellows or a cover plate is employed. When used in an interior application a cover plate may be employed to form a bridge over the expansion joint to provide a continuous flooring or to provide additional fire resistance. The fabric is attached to adjacent structure by mounting flanges in the form of a bifurcated clamp, and one of the fabric-engaging clamp faces may be crimped and pierced to better grip the fabric.

8 Claims, 3 Drawing Sheets

FIRE RESISTANT EXPANSION JOINT

CROSS REFERENCE TO RELATED APPLICATION

This application is a continuation-in-part of U.S. application Ser. No. 208,696, filed June 20, 1988, now U.S. Pat. No. 4,866,898.

FIELD OF THE INVENTION

This invention relates generally to expansion joints. More particularly, it relates to fire resistant expansion joints.

BACKGROUND OF THE INVENTION

Building structures often incorporate expansion joints to accommodate the movement of structural elements as a result of temperature changes or seismic activity Local building codes in addition often require expansion joints to meet minimum requirements for fire resistance. This means that the fire barrier assembly used to close the expansion joint opening must not only be capable of accommodating movement, but must in addition be capable of resisting flame penetration while limiting heat rise through the joint to the level prescribed in the code. When the expansion joint is part of the building envelope it must also be weather proof. This of course is not a requirement for interior expansion joints such as those used in connection with curtain walls which are not tied into the floor, as in modern hospital construction.

Prior attempts to provide suitable fire barrier assemblies have not been satisfactory from an economical point of view because they are either too costly to manufacture or too labor intensive to install. An example of prior art methods of providing a weather proof fire resistant expansion joint can be found in U.S. Pat. No. 4,517,779 to Dunsworth. This patent discloses a joint cover comprising a hollow barrier which allows the relatively movable structural elements beneath it to slide along the bottom surface of the cover. The hollow cavity of the cover contains a hygroscopic material that releases coolant liquid by a wicking process when the barrier assembly is exposed to high temperatures. In addition, a separate smoke barrier in the form of flexible refractory cloth is employed. It is apparent that an installed assembly of this type is quite expensive.

A simpler arrangement is disclosed in U.S. Pat. No. 4,566,242 to Dunsworth wherein a slide plate covers the void between adjacent floors in an internal expansion joint assembly. A refractory fiber cloth jacket functions as a smoke barrier and as a support for refractory insulation which acts as a heat barrier. While this arrangement is considerably simpler in design and less expensive than the assembly of U.S. Pat. No. 4,517,779, it is designed for use only as an internal expansion joint and requires the refractory cloth and insulation to be quite wide in order to extend out to the lower legs of the clamping brackets 22 and 24. This results in the smoke and heat barrier assembly costing still more than desired Further, the installation of the assembly, which requires the clamping brackets to be bolted to the floor sections and the grout faces, is still more labor intensive than desired. In addition, penetration of the refractory material by the bolts introduces an unwanted source of heat transmission.

It would obviously be beneficial to have a fire resistant expansion joint design which not only performs the functions required of it but which also has a relatively low installed cost as a result of economies of manufacture and the ability to rapidly install the system.

SUMMARY OF THE INVENTION

This invention provides an expansion joint fire barrier which comprises an elongated flexible fire resistant sheet the side edges of which are attached to mounting flange means. Each mounting flange means is connected to one of the spaced relatively movable members which defines the expansion joint to thereby support the flexible sheet between the spaced members. The flexible sheet, which is curved across its width to accommodate movement of the spaced members, supports resilient fire resistant insulation. The flexible sheet thereby functions as a smoke barrier, and the combination of the flexible sheet and the resilient insulation functions as a barrier to flame and to excessive heat rise.

By locating the portion of the mounting flange which is attached to the flexible sheet in the space between the spaced members, the side edges of the flexible sheet are able to terminate within the space, thus considerably reducing the required width of the sheet and of the insulation supported thereon. Preferably, the sheet is connected to the mounting flanges by means of bifurcated clamps, which facilitates this arrangement. At least one of the gripping surfaces of each bifurcated clamp preferably comprises a crimped portion which contacts the associated edge portion of the flexible sheet, thereby providing a highly efficient clamping or gripping mechanism for holding the flexible sheet in place without the need to attach the sheet to the top surface of the spaced movable members. In addition to the use of a crimped portion the flange may be pierced to form gripping teeth, as disclosed in more detail in Application Ser. No. 900,936, filed Oct. 17, 1986, now U.S. Pat. No. 4,750,301 dated June 14, 1988, and assigned to the assignee of this application.

In a preferred embodiment the flexible fire resistant sheet comprises an inorganic fabric including silica fibers, and the resilient insulation comprises an inorganic fibrous layer including refractory fibers.

The expansion joint cover used in conjunction with exterior installations of the fire barrier comprises an elongated flexible bellows which is attached by means of mounting flanges connected to the spaced members of the expansion joint so that the bellows covers the space between the members. Alternatively, the expansion joint cover comprises a cover plate mounted to permit the plate to slide over the expansion joint upon relative transverse movement of the spaced members of the joint. Cover plates may also be used in interior expansion joint installations to provide a bridge across the spaced members of the joint and to provide added fire resistance.

This arrangement provides all the functions required of a fire resistant expansion joint and in addition is economical to manufacture and relatively simple and fast to install, thus meeting all the goals of the invention.

Other features and aspects of the invention, as well as other benefits of the invention, will readily be ascertained from the more detailed description of the invention which follows.

DESCRIPTION OF THE PREFERRED EMBODIMENT

Figure 1:
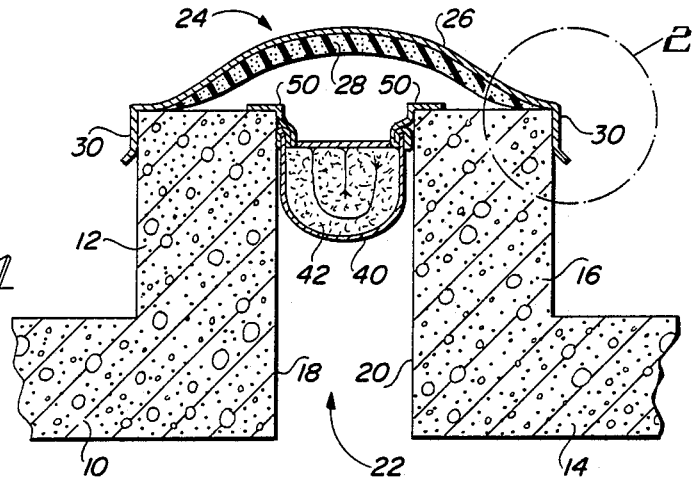
FIG. 1 is a partial transverse sectional view of the expansion joint of the present invention, illustrating the joint cover and the fire barrier assembly.

Referring to FIG. 1, roof section 10 and roof curb 12 of a building structure are spaced from roof section 14 and curb 16 of the same structure. The space between the resulting opposed interior surfaces 18 and 20 forms an expansion joint 22 which is protected from the elements by waterproof cover 24. The cover 24 comprises a bellows or sheet of waterproof material 26, such as a suitable elastomeric membrane, overlying a layer of plastic foam 28 provided for bellows support. The foam may conveniently take the form of closed cell polyethylene foam. A similar bellows and bellows support product is produced by Manville Corporation under the name of EXPAND-O-FLASH.

Figure 2:
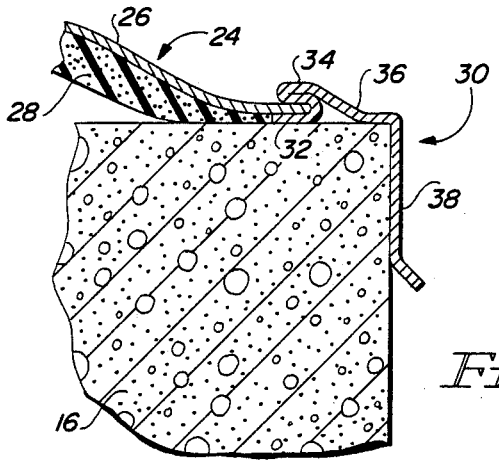
FIG. 2 is an enlarged partial transverse sectional view taken through the right flange and connected edge portion of the bellows of the expansion joint cover shown in FIG. 1.

The ends of the sheet 26 are attached to mounting flanges 30 which are connected to the curbs 12 and 16 adjacent the outermost corners thereof. As shown in more detail in FIG. 2, the end of the sheet 26 extends beyond the end of the foam layer 28 and is received between opposed segments 32 and 34 of the leg 36 of flange 30. The opposed segments 32 and 34 are formed as a result of reverse folding operations on the end portion of the flange leg 36, which are well known in the art and need not be described in detail herein. Preferably, the flange includes a leg 38 extending at right angles to the leg 36 so that the juncture between the legs coincides with the outer upper corner of the curb 16.

Figure 3:
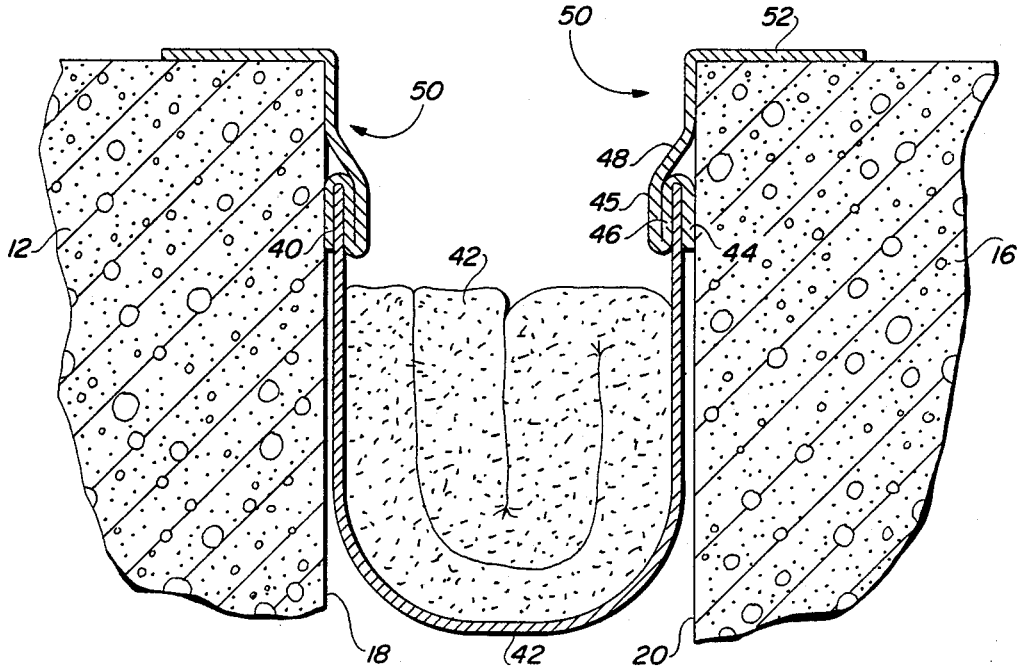
FIG. 3 is an enlarged partial transverse sectional view showing the fire barrier assembly in more detail.

Referring now to FIGS. 1 and 3, the expansion joint contains a fire barrier mounted between the surfaces 18 and 20. The fire barrier consists of a flexible fire resistant sheet 40 supporting resilient fire resistant insulation 42. The ends of the flexible sheet 40 are gripped between opposed segments 44 and 46 of the leg 48 of mounting flange 50. The opposed segments 44 and 46 may be formed by a folding operation similar to the process by which the flange 30 was folded, comprising opposed faces of a bifurcated clamp arrangement. In such an arrangement the segment 46 is in back-to-back relationship with the segment 45 which extends directly from the flange leg 48. If desired, in addition to the clamping pressure exerted by the folded flange segments, suitable adhesive may also be used to assist in holding the flexible sheet in place. The leg 48 of the flange 50 engages the interior surface 20 of the curb 16 while the leg 52, which extends at right angles to the leg 48, engages the upper surface of the curb 16 so that the juncture between the legs 48 and 52 meet at the upper inside corner of the curb. A similar arrangement exists at the other curb with the other flange 50.

The flexible sheet 40 may comprise any suitable material which is resistant to flame and is a barrier to smoke, such as refractory cloth which is readily available from a number of sources. A high temperature silica fiber fabric is a preferred material because of its good performance in these areas. Although only a single thickness of fabric is shown in the drawings, it will be understood that multiple layers may be used wherever additional heat or flame resistance is required or where the function of a smoke barrier requires it.

Any suitable fire resistant insulation may be used as long as it is resilient to a degree which permits it to be compressed when the spaced members 12 and 16 of the expansion joint move toward each other and to spring back when the spaced members move away from each other. A fire resistant fibrous insulation such as a layer or blanket formed of refractory fibers is preferred because it possesses these necessary properties and is readily availability. An example of such material is a product produced by Manville Corporation and sold under the name CERABLANKET. Because refractory fiber blankets are available in certain thicknesses only, it may be necessary to use multiple layers of blankets in order to provide the desired degree of fire protection. For example, if a two-hour rating of the joint is desired, a depth of four inches of 4 pcf insulation would be required, and for a four-hour rating a depth of six inches would be required. It should be understood that the term "refractory fibers" is intended to include fibers often referred to as "ceramic fibers".

Referring to FIG. 3, it will be seen that the fabric or flexible sheet 40 hangs from the mounting flanges 50 to form an open channel or trough in which the insulation 42 is supported. This arrangement is quite suitable for horizontal installations where there is no danger of the insulation 42 being dislodged from the fabric channel.

Figure 4:
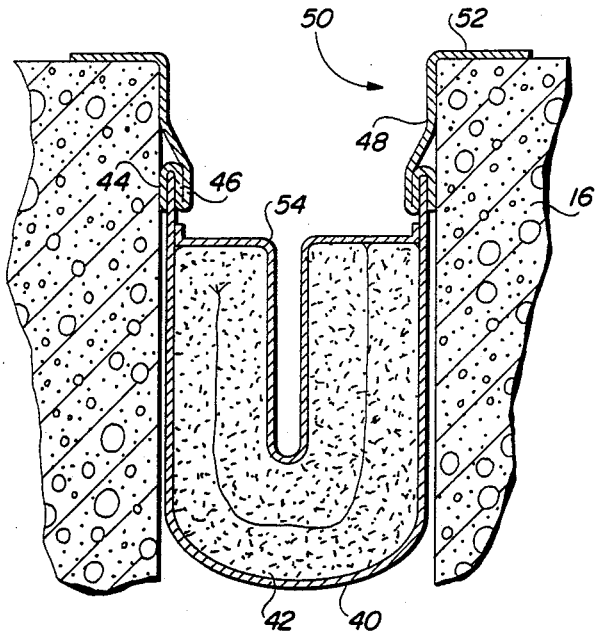
FIG. 4 is a view similar to that of FIG. 3, but showing a modified arrangement incorporating a second flexible sheet for encapsulating the resilient insulation.

Referring to FIG. 4, it will be seen that an upper horizontal strip 54 of the fabric has been provided. The strip 54, which connects the upper vertical portions of the flexible sheet just below the bifurcated clamp portions of the flanges 50, functions in combination with the sheet 40 to encapsulate the insulation. The sheets 40 and 54 are thus able to hold the insulation blankets 42 in place in installations where the insulation may be dislodged from the open channel arrangement of FIG. 3, such as in a vertical installation. The ends of the strip 54 are joined to the vertical portions of the sheet 40 by any suitable means such as by sewing or by otherwise bonding the two together.

Figure 5:
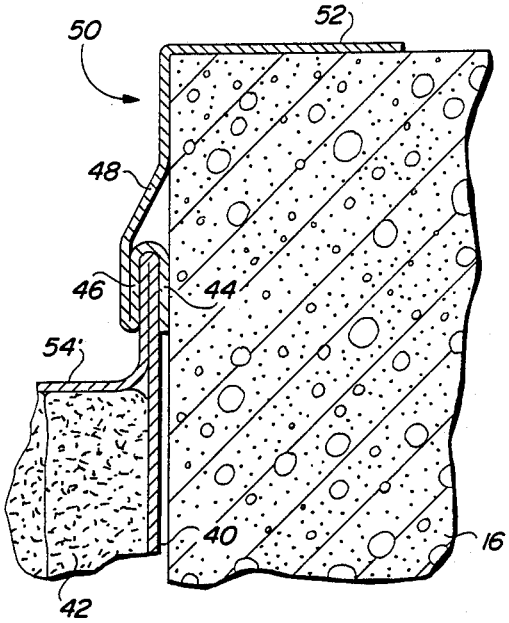
FIG. 5 is an enlarged partial sectional view taken through the right flange and connected edge portion of the fire resistant flexible sheet of the FIG. 4, but showing a modified arrangement incorporating two flexible sheets.

The strip may also be connected in a different manner, as illustrated in FIG. 5. In this arrangement the strip 54' is not joined directly to the upper vertical portion of the sheet 40 but extends up into the bifurcated clamp portion of the flange leg 48, where it is disposed in face-to-face contact with the upper end portion of the sheet 40 and is gripped in the same manner as the upper end portion of the sheet.

Figure 6:
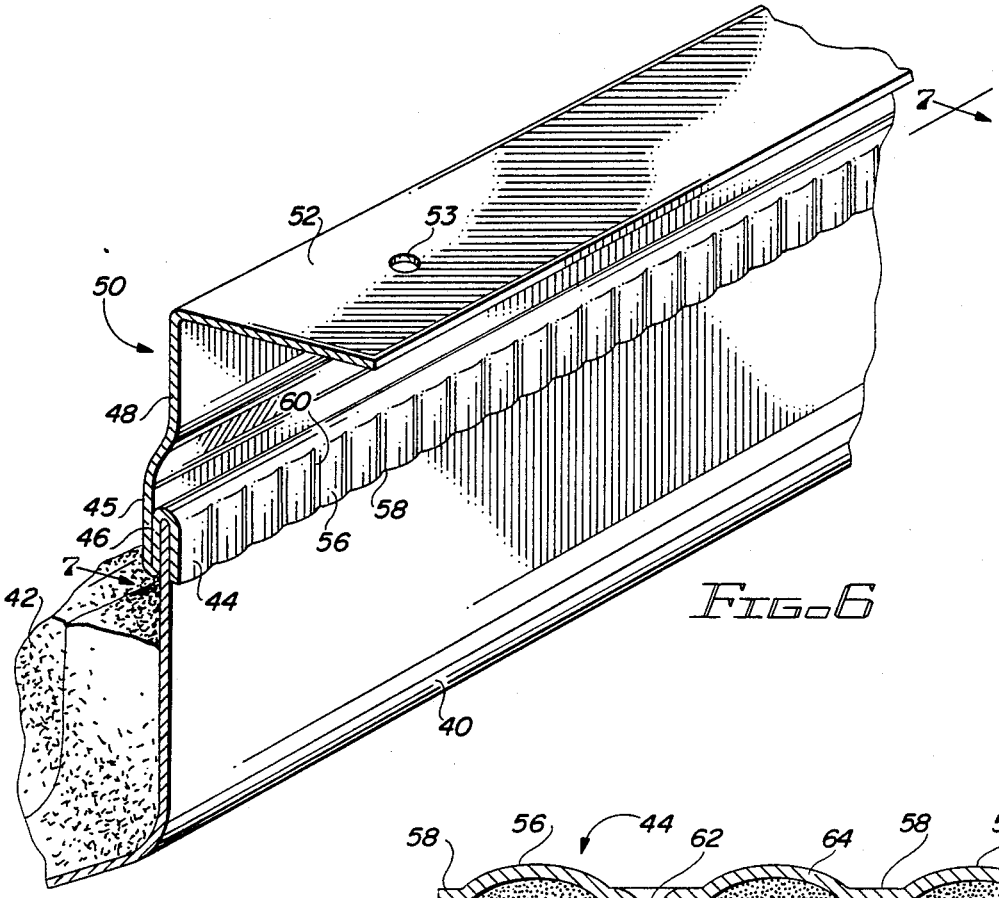
FIG. 6 is a partial pictorial view of a mounting flange and connected flexible fire resistant sheet, showing the preferred bifurcated clamp design of the mounting flange.

Referring to FIG. 6, the leg 52 of the mounting flange 50 preferably contains regularly spaced preformed holes 53, only one of which is shown, for receiving mechanical fasteners used to attach the flange to the outer surface of the parapets. In addition, the bifurcated clamp employed to grip the end portions of the sheet 40 preferably includes a corrugated or crimped clamping member. In the embodiment illustrated the clamping segment 44 has been crimped to form corrugations 56 and valleys 58. The segment 44 has further been pierced in a valley as at 60 in order to provide a better grip between the bifurcated clamp and the sheet.

Figure 7:
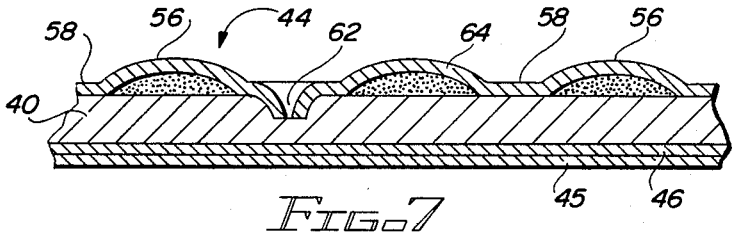
FIG. 7 is an enlarged sectional view taken on line 7—7 of FIG. 6, showing the detailed arrangement of the bifurcated clamp of FIG. 6 and the flexible sheet gripped thereby.

As shown in more detail in FIG. 7, the sheet 40 is held between clamp segments 44 and 46, with the valley portions 58 of segment 44 tightly gripping the sheet. The piercing operation results in the formation of teeth 62 which function to frictionally grip or even slightly penetrate the surface of the sheet 40 without, however, penetrating entirely through the sheet. These teeth aid in the gripping of the sheet, especially if the adhesive 64, shown as being located primarily between the sheet 40 and the corrugations 56, tends to cause slippage between the segment 44 and the sheet 40 prior to the final setting of the adhesive. For more information on this arrangement, reference may be had to the aforementioned Application Ser. No. 900,936, filed Oct. 17, 1986, now U.S. Pat. No. 4,750,301.

Figure 8:
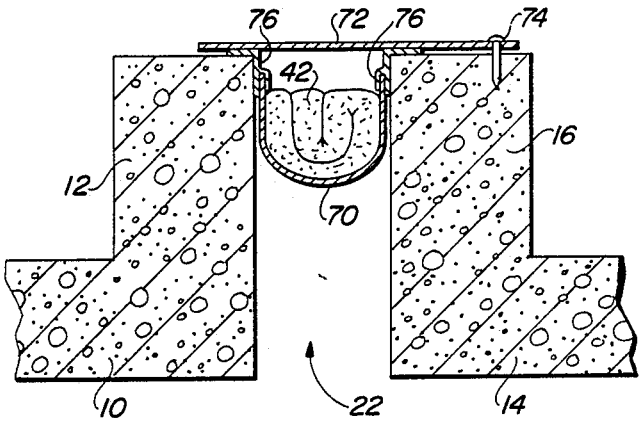
FIG. 8 is a partial sectional view similar to that of FIG. 1, but showing a modified arrangement.

Referring now to FIG. 8, an expansion joint 22 similar to the expansion joint shown in FIG. 1 is formed by spaced roof sections 10 and 14 and associated curbs 12 and 16. As in the arrangement of FIG. 1, a fire barrier is provided which consists of a flexible fire resistant sheet 70, such as refractory cloth, supporting a resilient fire resistant insulation 42, such as a layer or blanket of refractory fibers. Instead of a bellows, however, a cover plate 72 is provided to prevent moisture from entering the expansion joint. It will be understood that a similar arrangement could be used in an interior expansion joint, with the cover plate providing a bridge over the joint to form a continuous floor and provide additional fire resistance. The cover plate may be of any suitable design the details of which are not significant to the invention, but in any event will be mounted so as to allow the plate to cover the space between the members of the expansion joint during relative movement of the members. For purpose of illustration, the cover plate 72 is shown as being attached by fastener 74 to the curb 16 but not to curb 12 so that upon relative transverse movement of the roof elements toward or away from each other, the cover plate will be capable of sliding over the upper surface of the curb 12 and will be long enough to always cover the gap between the curbs even when they are spaced apart their maximum design distance. The insulation may be uncovered in the supporting trough formed by the flexible sheet 70, as in the arrangement of FIG. 3 and as illustrated in FIG. 8, or it may be supported in an enclosed sleeve as shown in FIG. 4. In either case a cover plate may be used instead of a bellows for providing a water barrier in an exterior installation or, as mentioned above, to bridge the space between the members forming the expansion joint. As further illustrated in FIG. 8, the ends of the flexible sheet 70 are attached to mounting flanges 76 in the same manner as flanges 50 in the embodiment shown in FIGS. 1 and 3.

Figure 9:
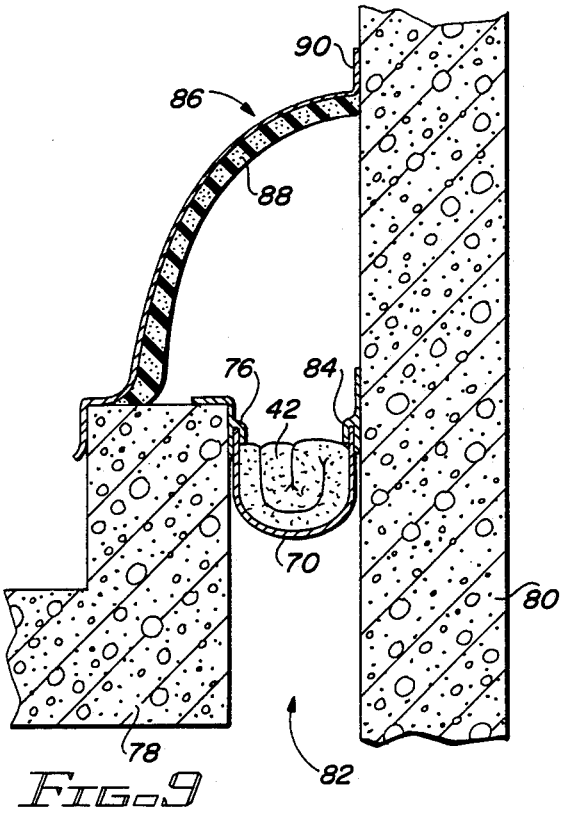
FIG. 9 is a partial sectional view of an embodiment of the invention adapted for use with a roof and an adjacent wall.

Referring now to FIG. 9, a roof 78 is spaced from a wall 80 to form an expansion joint 82. A trough formed by flexible sheet 70 supports the fire resistant insulation 42 in the same manner as in the FIG. 8 arrangement, except that the mounting flange 84 forms an extension of the substantially vertical upper portion of the trough wall to which it is attached. This enables the mounting flange 84 to be attached directly to the side surface of the curtain wall 80. The other mounting flange 76, as in the arrangement of FIG. 8, is angled to allow it to be attached to the upper surface of the adjacent curb of the roof deck 78.

Covering the expansion joint 82 to prevent entry of moisture is a bellows 86 comprised of the usual inner layer of foam plastic 88 and an outer membrane layer 90. In this case, the membrane 90 is attached to the side of the wall 80 and the other end of the bellows is attached to the outer corner of the curb or parapet of roof deck 78.

Figure 10:
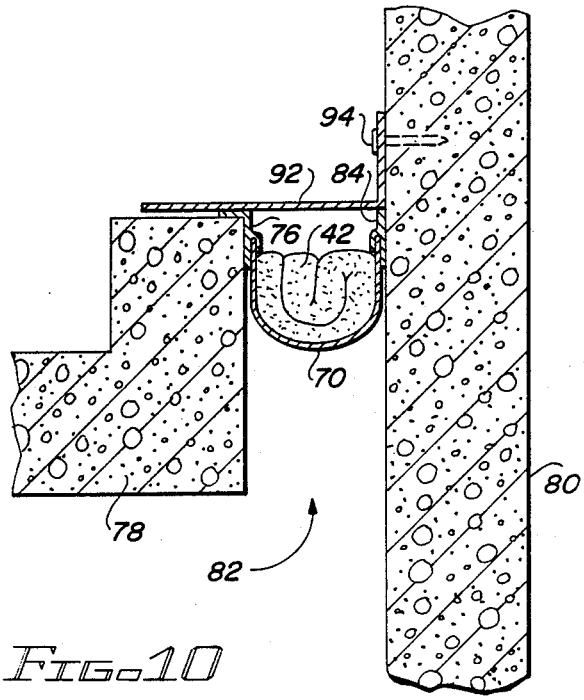
FIG. 10 is a partial sectional view of another embodiment of the invention adapted for use with a roof and an adjacent wall.

A similar arrangement is illustrated in FIG. 10, wherein the moisture barrier is comprised of a cover plate 92 instead of bellows, with one end of the bellows being angled as shown to permit attachment to the wall 80 at 94. As in the cover plate installation of FIG. 8, the cover plate 92 would not be attached to the roof deck structure 78 so that upon relative movement of the wall 80 and the roof deck 78 the cover plate will slide with respect to the roof deck to keep the expansion joint covered at all times.

Figure 11:
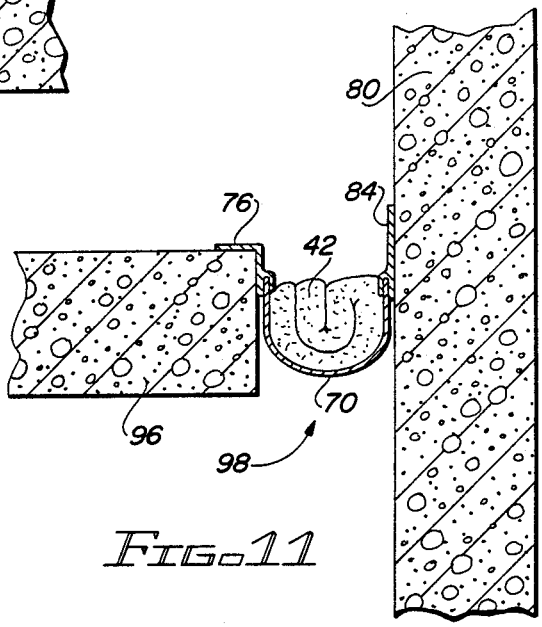
FIG. 11 is a partial sectional view of a fire barrier of the type shown in FIGS. 9 and 10 in an interior installation between a floor and a wall.

As shown in FIG. 11, the fire barrier of the invention may be installed in an expansion joint 98 formed between an interior floor 96 and a wall 80. In this arrangement the attachment flanges 76 and 84 which are connected to the flexible sheet 70 are secured to the floor 96 and the curtain wall 80 in the same manner as in the exterior installation shown in FIG. 10. While the insulation 42 is shown as being supported in an uncovered trough formed by the flexible sheet 70, it will be understood that the fabric could be covered to form a sleeve.

It should now be clear that the present invention provides a simple, economical and highly effective fire resistant expansion joint due to a number of characteristics. The width of the smoke and flame barrier has been considerably reduced as a result of attachment means which allow the side edges of these elements to be located adjacent the boundaries of the expansion joint space. This arrangement is enhanced by the gripping engagement of the flexible sheet or fabric by the bifurcated clamp. The efficiency and effectiveness of the clamp itself is further increased by the use of adhesive and gripping teeth within the jaws of the bifurcated clamp. For exterior installations, the arrangement of elements in the invention further permits the flame and smoke barrier to be quickly installed prior to the installation of the weather proof expansion joint cover so that neither installation interferes with the other.

It should now be understood after reading the foregoing description that the invention is not necessarily limited to all the specific structural details described, but that changes to certain features of the preferred embodiments which do not affect the overall function and concept of the invention may be made by those skilled in the art without departing from the spirit and scope of the invention, as defined in the appended claims.

What is claimed is:

1. In an expansion joint having spaced members subject to relative transverse movement, a fire barrier comprising:

an elongated flexible fire resistant sheet having side edge portions;

mounting flange means attached to the side edge portions of the flexible sheet;

each mounting flange means being connected to one of the spaced members to support the flexible sheet adjacent the spaced members;

resilient fire resistant insulation supported by the flexible sheet;

the flexible sheet being comprised of inorganic refractory fiber and the insulation being comprised of inorganic refractory fibers; and the flexible sheet being curved across its width to accommodate movement of the spaced members away from each other.

2. The fire barrier of claim 1, wherein the flexible fire resistant sheet comprises a sleeve, and the resilient fire resistant insulation is contained within the sleeve.

3. The fire barrier of claim 1, including cover plate means bridging the spaced members, and means permitting movement of the cover plate means corresponding to the relative movement of the spaced members so as to cover the space between the spaced members at all times.

4. The fire barrier of claim 1, including means for preventing the entry of moisture into the expansion joint.

5. The fire barrier of claim 4, wherein the means for preventing the entry of moisture into the expansion joint comprises a cover plate covering the space between the spaced members, and means permitting movement of the cover plate corresponding to the relative movement of the spaced members so as to cover the space between the spaced members at all times.

6. An external weather resistant expansion joint between two spaced members subject to relative transverse movement, comprising:

an elongated cover plate having side edge portions;

means holding the cover plate in place but permitting the cover plate to cover the space between the spaced members at all times to protect the space against the entry of water;

an elongated flexible fire resistant sheet having side edge portions;

mounting flange means attached to the side edge portions of the flexible sheet;

each mounting flange means being connected to one of the spaced members to support the flexible sheet between the spaced members and beneath the cover plate; and resilient fire resistant insulation supported by the flexible sheet;

the flexible sheet being curved across its width to accommodate movement of the spaced members away from each other.

7. The expansion joint of claim 6, wherein the flexible fire resistant sheet comprises an inorganic refractory fabric, and wherein the resilient fire resistant insulation comprises inorganic refractory fibers.

8. The expansion joint of claim 6, wherein the flexible fire resistant sheet comprises a sleeve, the resilient fire resistant insulation being contained within the sleeve.

* * * * *